US007005597B2

(12) United States Patent
Mori

(10) Patent No.: US 7,005,597 B2
(45) Date of Patent: Feb. 28, 2006

(54) SWITCH DEVICE

(75) Inventor: Toshiharu Mori, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/947,776

(22) Filed: Sep. 22, 2004

(65) Prior Publication Data

US 2005/0077162 A1 Apr. 14, 2005

(30) Foreign Application Priority Data

Oct. 8, 2003 (JP) ..... 2003-349213

(51) Int. Cl.
*H01H 37/02* (2006.01)

(52) U.S. Cl. ..... 200/336; 337/351; 337/334

(58) Field of Classification Search ..... 200/330–339, 200/4, 11 R, 11 A, 11 D, 11 DA, 564, 566, 200/567, 570, 572; 337/101–107, 334, 351, 337/360

See application file for complete search history.

(56) References Cited

U.S. PATENT DOCUMENTS

| | | | | |
|---|---|---|---|---|
| 3,932,830 | A | 1/1976 | Holtkamp | |
| 3,943,479 | A | 3/1976 | Turner | |
| 5,786,742 | A * | 7/1998 | Yin | 337/66 |
| 5,929,742 | A * | 7/1999 | Short | 337/348 |
| 6,100,480 | A * | 8/2000 | Takahashi | 200/330 |
| 6,445,273 | B1 * | 9/2002 | Yu | 337/37 |
| 6,563,414 | B1 * | 5/2003 | Yu | 337/66 |
| 6,617,952 | B1 * | 9/2003 | Yu | 337/94 |

* cited by examiner

*Primary Examiner*—Elvin Enad
*Assistant Examiner*—M. Fishman
(74) *Attorney, Agent, or Firm*—Beyer, Weaver & Thomas LLP.

(57) ABSTRACT

A switch device capable of increasing the operation speed at the time of reversion of contacts, thereby suppressing generation of arcs, and capable of increasing the contact pressure between the contacts, thereby reducing the bouncing of the contacts. A first rotor plate and a second rotor plate are operatively coupled with each other with a torsion coil spring and when the first rotor plate is rotated, a reversing force from the torsion coil spring causes the contact driving part to engage with or disengage from the contact plate.

5 Claims, 7 Drawing Sheets

SWITCH DEVICE

BACKGROUND OF THE INVENTION

1. Field of the Invention

The present invention relates to a switch device, and in particular, to a structure of a switch device used in a temperature controller of electric cooking appliance such as an electric oven.

2. Description of the Related Art

As conventional switch devices, a switch device is known in which the device is actuated by a control group comprising a temperature sensor such as a heating type thermo-bimetal in controlling the output of a heater of an electric oven (See Japanese Patent No. 2631376).

FIGS. 12 and 13 show a structure of a conventional switch device. FIG. 12 is a plan view showing the inside of the switch device, and FIG. 13 is a partially detailed view showing principal parts of the device.

In these drawings, a switch device 101 is a time-setting-type output control device comprising an appliance switch 106. This switch 106 is actuated by a heating-type thermo-bimetal 115. The switch device 101 is a snap switch. The switch device 101 has an adjusting unit 139 for changing the gap between a contact 136 and a counter stop 137. The counter stop 137 is used for a movable switch contact 134 and is actuated for changing the temperature setting range of the switch device.

In other words, in a lower setting range, the switching hysteresis of the appliance switch 106 becomes smaller, and in a higher setting range, the switching hysteresis of the appliance switch 106 becomes larger. Therefore, in the appliance switch 106, the time of connection during which the switch is turned on can be precisely set to a smaller value. As a result, in the lower setting range, the output control can be very precisely performed.

The switch device 101 is actuated in the following way. In a switched-off position, the switch contact 134 faces the contact 136, but making no contact, and is at a stop position of the counter stop 137. When a setting spindle 108 is located at a position in a switched-on range, the switch contact 134 moves to its closed position. In this closed position, the switch contact 134 abuts on the contact 136 by the levering action that is caused between a switch element 114 and a runner 146. A heating resistor 116 is switched on aside from electric appliance to be controlled.

When the heating resistor 116 heats the thermo-bimetal 115, the switch element 114 is biased toward the side on which a compensating unit 120 abuts on a spiral spring 118. In other words, the switch element 114 is biased in the direction that abuts on a pressing plate of a snap spring. This operation continues until a bi-stable snap spring 131 reaches its dead point, i.e., its switching point, and the snap spring 131 is resiliently bounced in the direction of the position of the other end thereof.

As a result, the switch contact 134 is separated from the contact 137 and abuts on the counter stop 137. Since the switch contact 134 is opened, current does not flow through the heating resistor 116. Then, the thermo-bimetal 115 returns back to the cold initial position. In other words, the dead point of the snap spring 131 is returned to its original position, and the snap spring 131 again is resiliently bounced toward the position of one end thereof. As a result, the switch contact 134 returns to its closed position.

[Disclosure of the Invention]

[Problems to be Solved by the Invention]

However, in a construction of the above-described conventional switch device, a switch contact is operated by the balance between a force from the bimetal and a force from the snap spring, the operational speed of the bimetal is slow. Therefore, arcs tend to fly at the time of the switching of the connection between the switching contacts. Further, since the force that pushes the switching contacts becomes small, the bouncing of the contacts tends to appear.

SUMMARY OF THE INVENTION

Accordingly, the present invention has been made to solve the above problems. An objective of the invention is to provide a switch device with excellent load life characteristics, capable of increasing the operational speed at the time of reversion of contacts, thereby suppressing generation of arcs, and capable of always applying the required load after the reversion of the contacts to increase the contact pressure between the contacts, thereby reducing the bouncing of the contacts.

[Means for Solving the Problems]

In order to solve the above problems, as a first aspect of the invention, there is provided a switch device comprising: a case having a receiving part, at least a pair of contact plates arranged in the receiving part, a first rotor plate arranged to be rotatable and having a contact driving part for pressing at least one of the contact plates, a second rotor plate operatively coupled with the first rotor plate, a rotating shaft that journals the first and second rotor plates, a bimetal piece engaged with the second rotor plate for rotating the second rotor plate with the rotation of the rotating shaft, a heater for heating the bimetal piece, and an actuating shaft for rotating the rotating shaft. When the actuating shaft is actuated, the bimetal piece causes the first rotor plate to rotate through the second rotor plate with the rotation of the rotating shaft, hence turning on the pair of contact plates. When the heater is heated to a predetermined temperature, the bimetal piece is displaced to cause the first rotor plate to rotate through the second rotor plate, hence turning off the pair of turned-on contact plates. When the first rotor plate and the second rotor plate are operatively coupled with each other with a torsion coil spring for reversing and the first rotor plate is rotated, a reversing force from the torsion coil spring causes the contact driving part to instantaneously engage with or to disengage from the contact plates.

Further, as a second aspect of the invention, the first rotor plate is formed with a first locking part, the second rotor plate is provided with a second locking part, the torsion coil spring is loosely engaged with the first and second locking parts, and when the first rotor plate rotates, the torsion coil spring floats in the first and second locking parts so that the torsion coil spring performs a reverse operation.

Further, as a third aspect of the invention, the distance from a rotational fulcrum of the rotating shaft to the locking part between the first rotor plate and the torsional coil spring is longer than the distance from the rotational fulcrum to the contact driving part.

Further, as a fourth aspect of the invention, the pair of contact plates are formed of a springy material having flexibility.

Further, as a fifth aspect of the invention, a plurality of the contact plates are arranged in the receiving part of the case, the contact plates are connected to a plurality of external terminals that lead out of the case, and the external terminals are arranged in a row at the bottom of the case.

BRIEF DESCRIPTION OF THE DRAWINGS

FIG. 4 is a plan view showing the principal parts when the switch device according to the present invention is turned on;

DESCRIPTION OF THE PREFERRED EMBODIMENT

Figure 1:
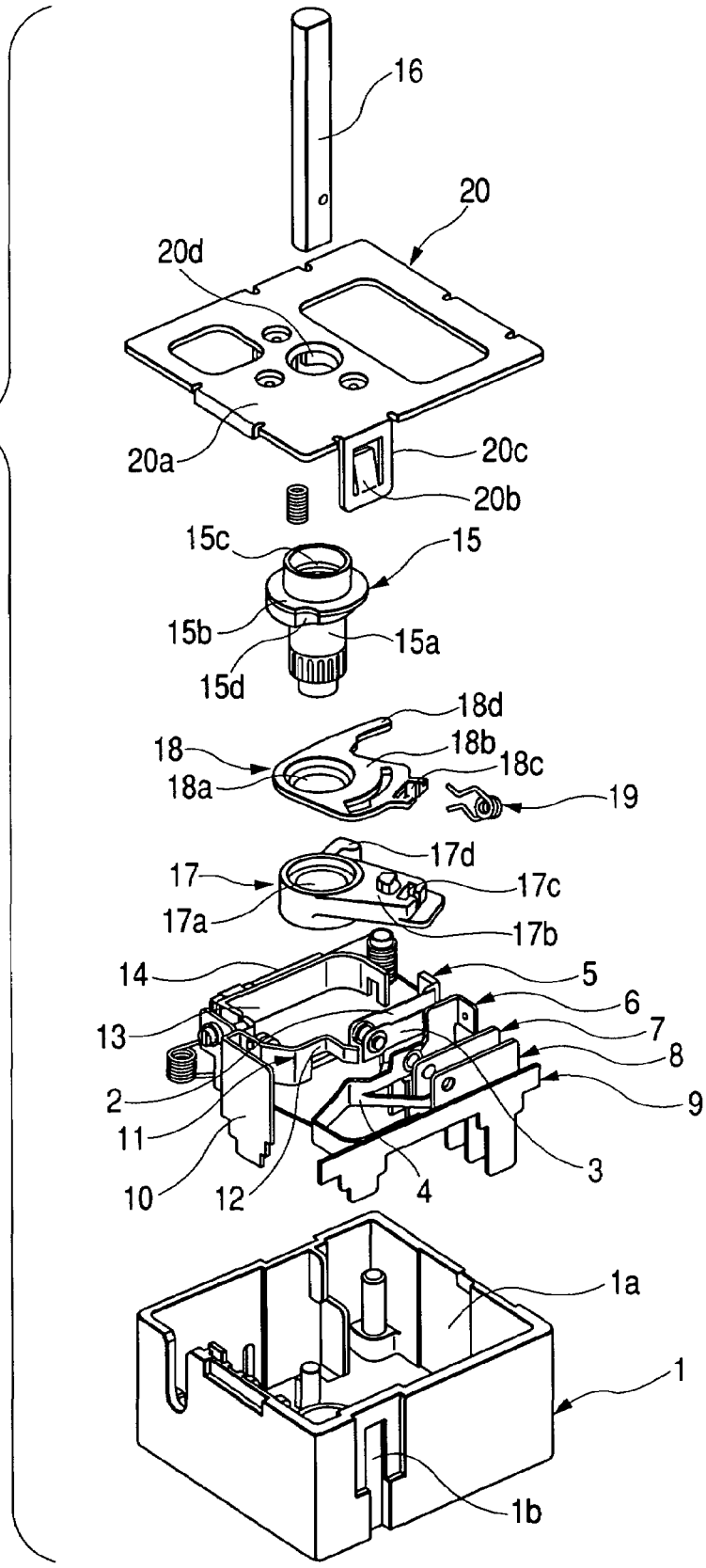
FIG. 1 is an exploded perspective view showing a switch device according to the present invention.
Figure 2:
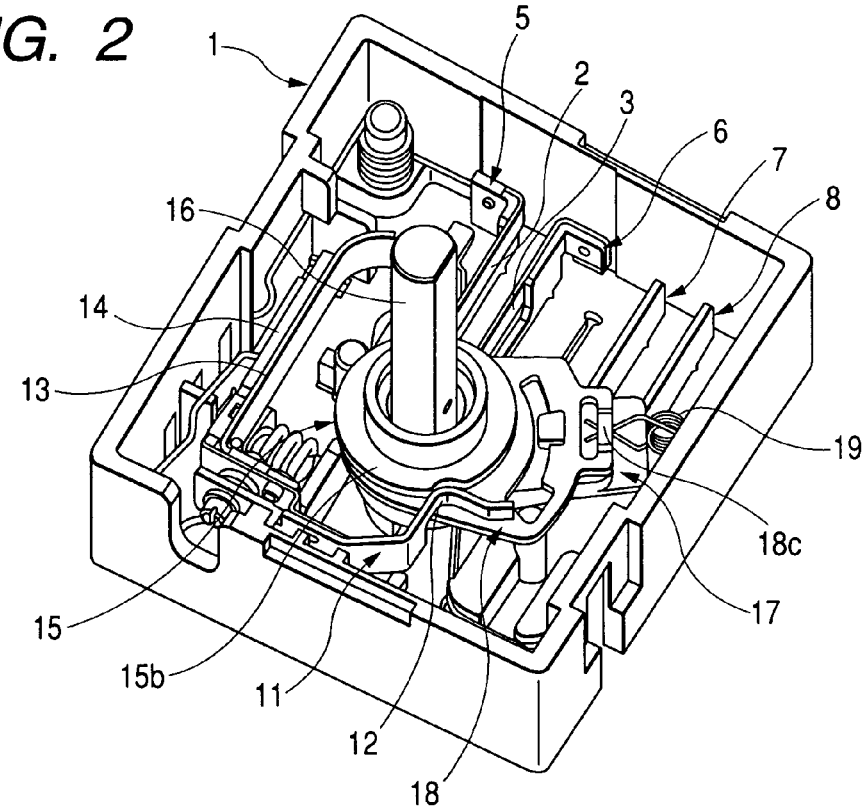
FIG. 2 is a perspective view showing principal parts of the switch device according to the present invention.
Figure 3:
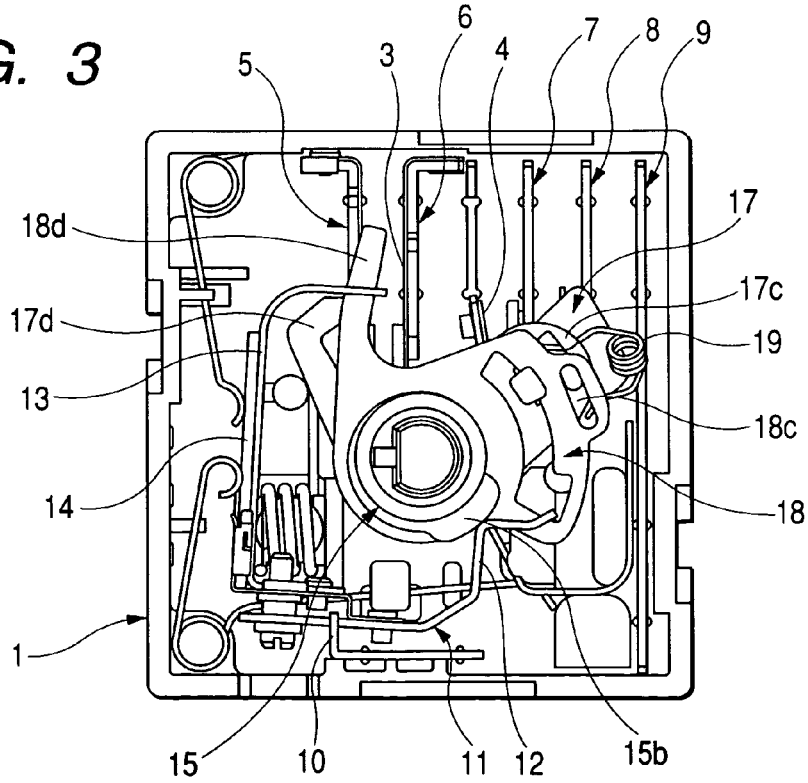
FIG. 3 is a plan view showing the principal parts when the switch device according to the present invention is turned off.
Figure 4:
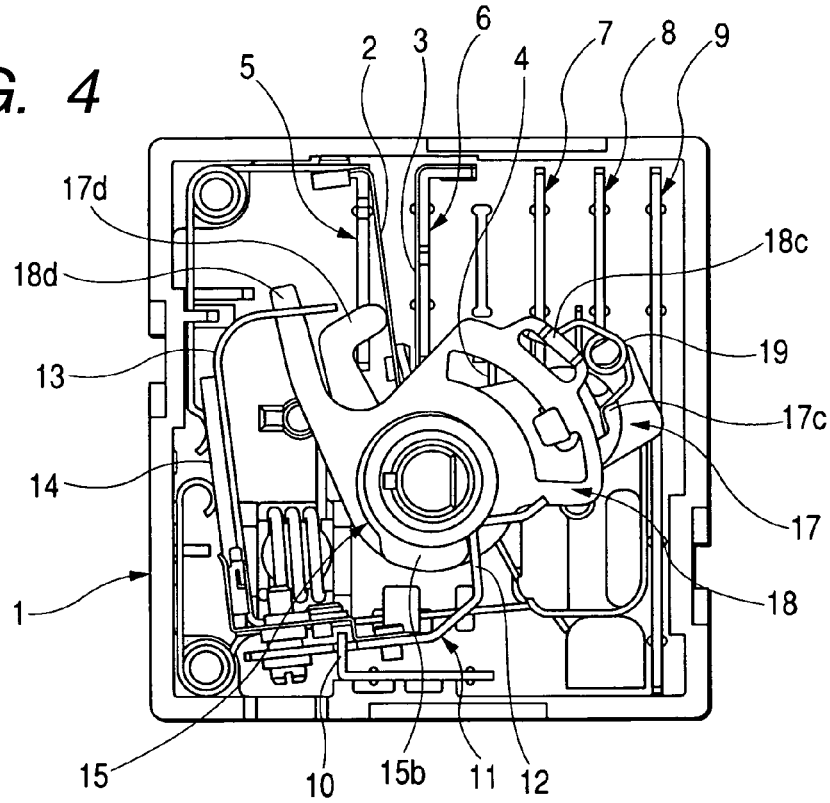
Figure 5:
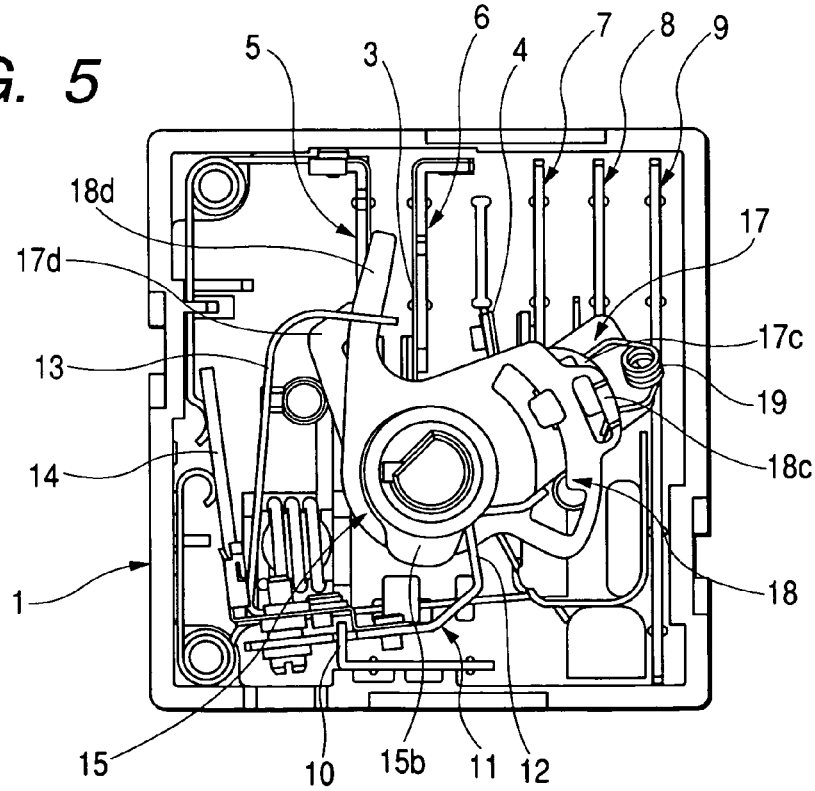
FIG. 5 is a plan view showing the principal parts when the switch device according to the present invention is turned off.
Figure 6:
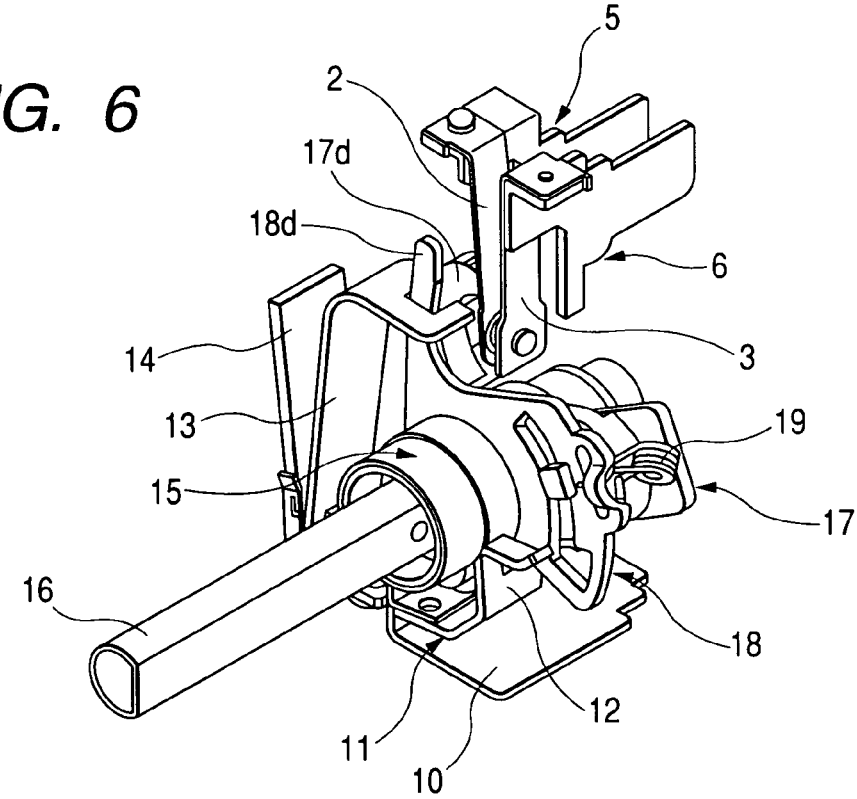
FIG. 6 is an explanatory view for explaining the operation of a torsion coil spring immediately before its reversion in a process shifted from the time when the switch device according to the present invention is turned on to the time when the switch device according to the present invention is turned off.
Figure 7:
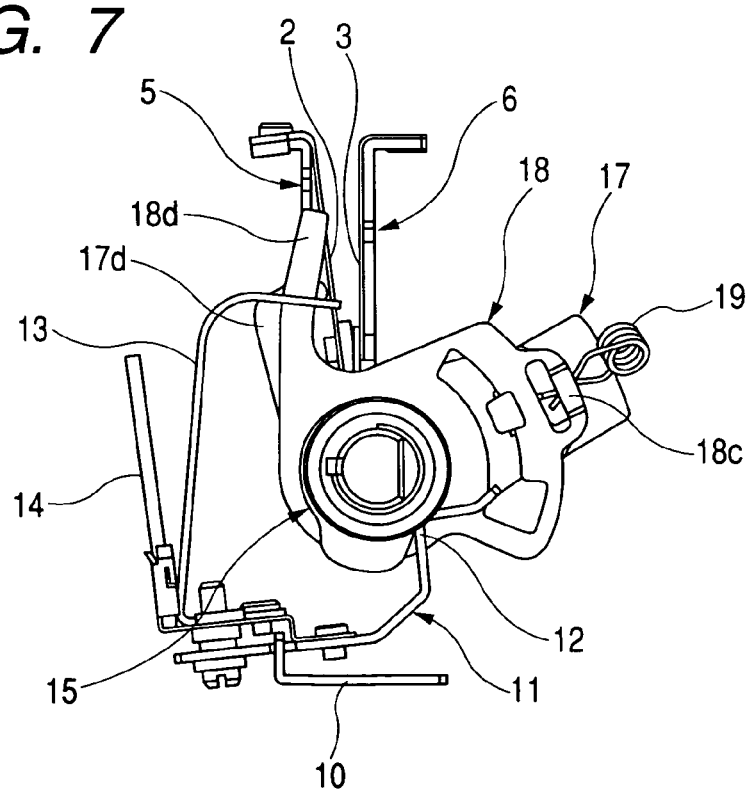
FIG. 7 is an explanatory view for explaining the operation of the torsion coil spring immediately before its reversion in the process shifted from the time when the switch device according to the present invention is turned on to the time when the switch device is turned off.
Figure 8:
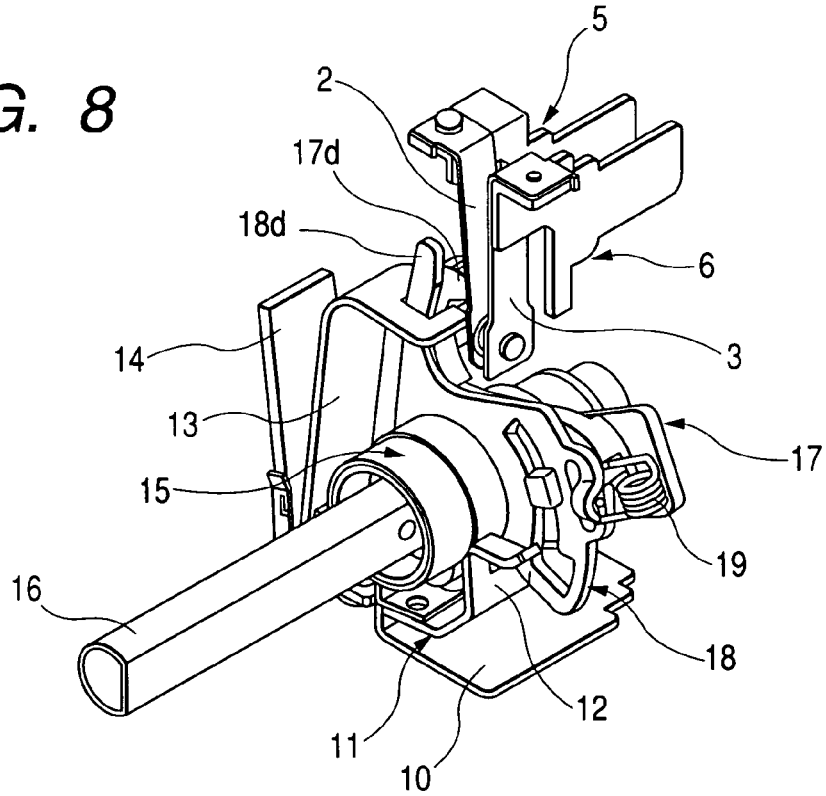
FIG. 8 is an explanatory view for explaining the operation of the torsion coil spring immediately after its reversion in the process shifted from the time when the switch device is turned on to the time when the switch device is turned off.
Figure 9:
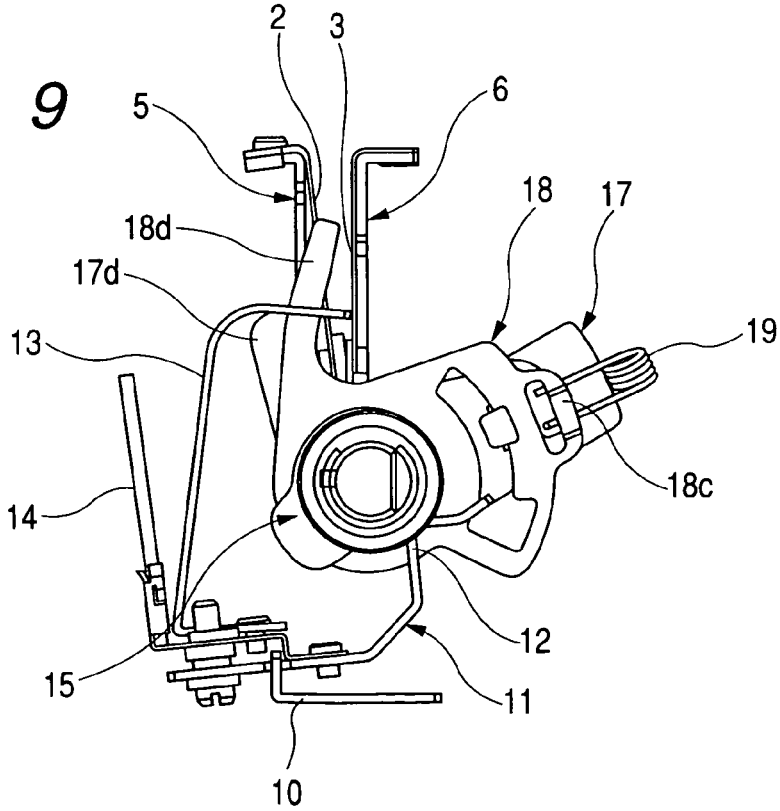
FIG. 9 is an explanatory view for explaining the operation of the torsion coil spring immediately after its reversion in the process shifted from the time when the switch device according to the present invention is turned on to the time when the switch device is turned off.
Figure 10:
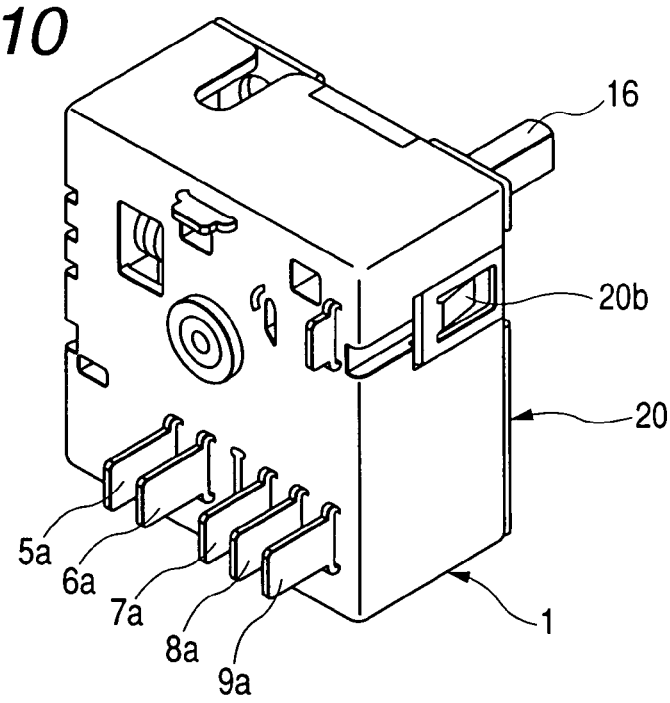
FIG. 10 is a perspective view as seen from the backside of the switch device according to the present invention.
Figure 11:
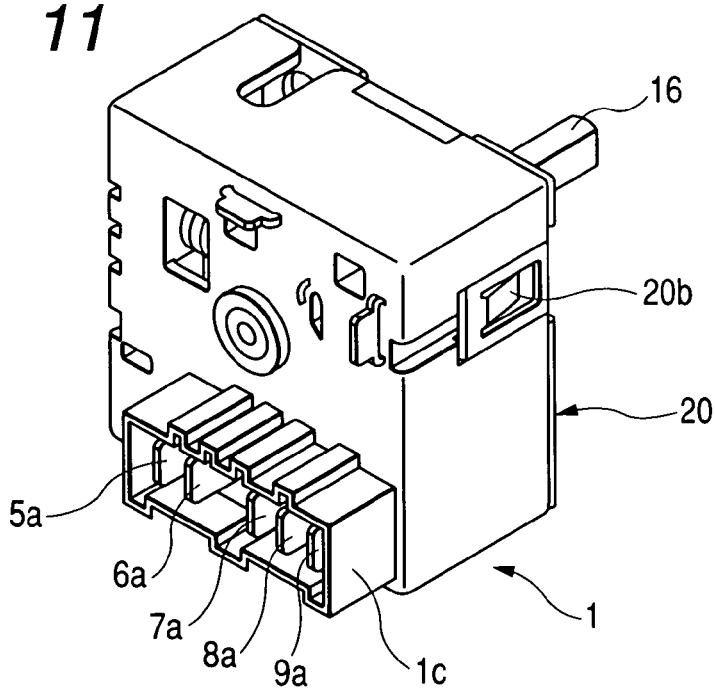
FIG. 11 is a perspective view as seen from the backside of the switch device according to the present invention.
Figure 12:
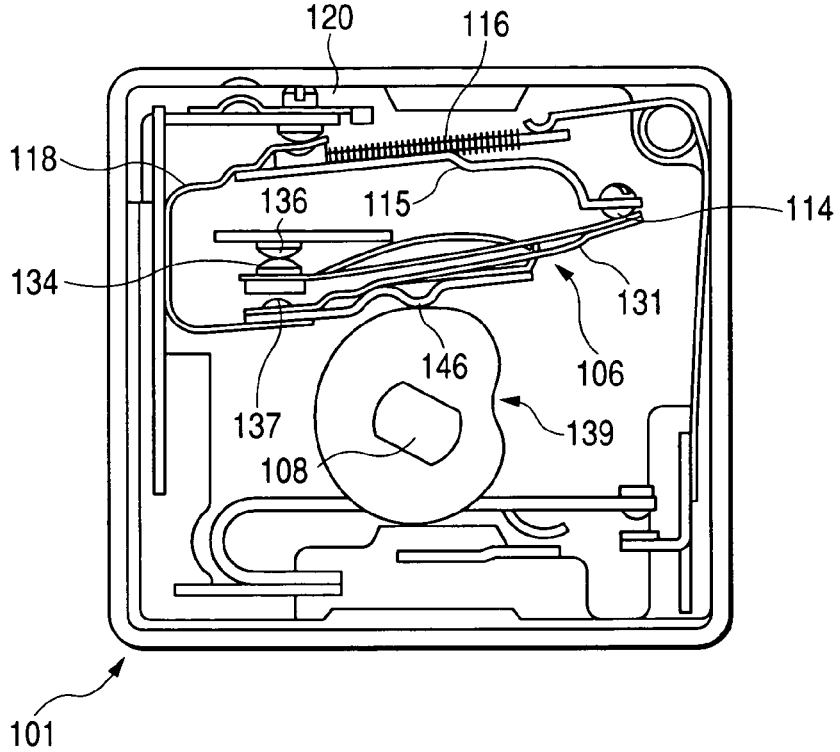
FIG. 12 PRIOR ART
FIG. 12 is a plan view showing the inside of a conventional switch device.
Figure 13:
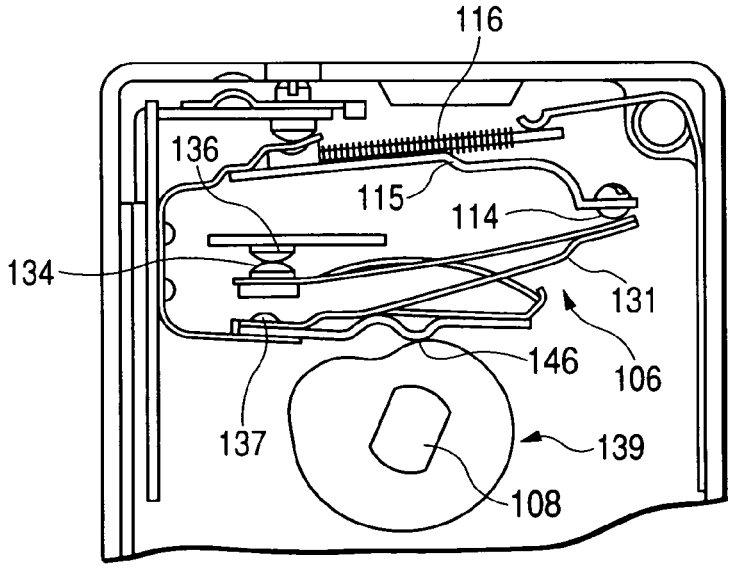
FIG. 13 PRIOR ART
FIG. 13 is a partially detailed view showing principal parts of the conventional switch device.

Hereinafter, an embodiment of a switch device according to the present invention is shown in FIG. 1 to FIG. 11. FIG. 1 is an exploded perspective view showing a switch device according to the present invention; FIG. 2 is a perspective view showing the principal parts of the switch device; FIG. 3 is a plan view showing the principal parts when the switch device is turned off; FIG. 4 is a plan view showing the principal parts when the switch device is turned on; FIG. 5 is a plan view showing the principal parts when the switch device is turned off; FIGS. 6 and 7 are explanatory views for explaining the operation of a torsion coil spring immediately before its reversion in a process shifted from the time when the switch device is turned on to the time when the switch device is turned off; FIGS. 8 and 9 are explanatory views for explaining the operation of the torsion coil spring immediately after its reversion in the process shifted from the time when the switch device is turned on to the time when the switch device is turned off; and FIGS. 10 and 11 are perspective views as seen from the backside of the switch device.

In these drawings, a case 1 is made of an insulating material such as a synthetic resin and is box-shaped with its top face open. The case 1 has a receiving part 1*a*. Further, mounting grooves 1*b* are respectively formed at a pair of opposite lateral faces of the case 1. Further, a plurality of contact plates 2 to 4 made of a conductive metallic plate and a plurality of terminal plates 5 to 9 connected to some of the contact plates 2 to 4 made of the same conductive metallic plate are arranged within the receiving part 1*a*.

Further, the contact plates 2 to 4 are formed of a thin metallic plate having flexibility, and have their own springiness. In this way, the contact plates 2 to 4 are formed of a springy material having flexibility, whereby the contact plates 2 to 4 are flexed at the time of switching of contacts. As a result, an impact can be softened to reduce noises at the time of the switching.

The terminal plates 5 to 9 are respectively arranged in parallel to each other at predetermined intervals at one side of the receiving part 1*a* while their ends at one side are exposed into the case 1. Further, the other ends of the terminal plates 5 to 9 are formed with external terminals 5*a* to 9*a* that protrude outwardly from the bottom of the receiving part 1*a*. The contact plates 2 and 3 are electrically conductive and connected to the terminal plates 5 and 6 of the terminal plates 5 to 9. The contract plates 2 and 3 are arranged to face each other with a certain gap therebetween.

Further, the contact plate 4 is electrically conductive and connected to the terminal plate 9. The contact plate 4 and the terminal plates 7 and 8 are arranged to face each other with a certain gap between them. Specifically, the contact plates 2 and 3 and the terminal plates 5 and 6 constitute a first switch unit, and the contact plate 4 and the terminal plates 7 to 9 constitute a second switch unit. Further, in an initial state, the contact plates 2 and 3 are electrically isolated from each other, and similarly, the contact plate 4 and the terminal plates 7 and 8 are electrically isolated from each other.

As shown in FIG. 10, the external terminals 5*a* and 9*a* lead out of the case 1, and the external terminals 5*a* to 9*a* are arranged in a row at the bottom of the case 1. The external terminals 5*a* to 9*a* are arranged in this way. As a result, at the time of wiring of harnesses, etc., the occurrence of erroneous wiring is prevented, and the workability is improved.

As shown in FIG. 11, if a holder part 1*c* is provided at the bottom of the case 1 so as to surround the external terminals 5*a* to 9*a*, a connector, etc., can be connected to the switch device, and the assembling property of a product can be improved.

Further, a rocking member 11 is arranged in the receiving part 1*a* and is pivotably supported to a support terminal 10. The rocking member 11 is substantially L-shaped. A driving plate part 12 is provided at one end of the support terminal 10 as a pivot and is driven with the rotation of a rotating shaft 15 which will be described later. Further, a bimetal piece 13 with its tip bent in the shape of "J" is provided at the other end of the rocking member 11, and a heater 14 is attached to the bimetal piece 13.

The rotating shaft 15 is formed of an insulating material such as a synthetic resin. The rotating shaft 15 has a cylindrical base part 15*a*, and a cam part 15*b* provided at the center of the base part 15*a* so as to protrude annularly. A cam surface 15*d* consisting of convex and concave portions is provided at a side surface portion of the cam part 15*b*. When the rotating shaft 15 rotates, the cam surface 15*d* allows the driving plate part 12 of the rocking member 11 to be driven.

Further, an engaging groove part 15*c* is provided on the upper side of the base part 15*a* and is engaged with an actuating shaft 16 for actuation from the outside. With the rotation of the actuation, the rotating shaft 15 also rotates.

The actuating shaft 16 is made of a metallic material, etc., and is rod-shaped. One end of the actuating shaft 16 is engaged with the engaging groove part 15*c* of the rotating shaft 15, and the other end is appropriately attached to an actuating knob (not shown) by which the rotating shaft 15 device is operated to rotate.

A first rotor plate 17 is made of an insulating material such as a synthetic resin and is substantially L-shaped. The center of the first rotor plate 17 is provided with an axial bore 17*a* through which the rotating shaft 15 is rotatably inserted to be rotatable. A rectangular base plate part 17*b* is provided on one side of the first rotor plate 17 with respect to the axial bore 17*a*. The tip of the base plate part 17*b* is provided with a first locking part 17*c* to which a later-described torsion coil spring 19 is floatingly locked.

Further, a contact driving part 17*d* is formed in the direction orthogonal to the direction in which the base plate part 17*b* extends with respect to the axial bore 17*a*. When the first rotor plate 17 rotates in operative association with the rotation of a second rotor plate 18 which will be described below, the tip of the contact driving part 17*d* abuts on the contact plate 2 that constitutes the first switch unit, thereby performing the opening or closing of the contact plates 2 and 3.

Further, a rotational fulcrum of the rotating shaft 15, i.e., the distance from the center of the axial bore 17*a* to the first locking part 17*c* is made longer than the distance from the center of the axial bore 17*a* to the tip of the contact driving plate 17*d*.

Using such a principle, the contact pressure applied to contacts can be set to be larger than the spring pressure applied by the torsion coil spring 19.

Similarly, a second rotor plate 18 is made of an insulating material such as a synthetic resin and is substantially L-shaped. Similarly, the center of the second rotor plate 18 is provided with an axial bore 18*a* through which the rotating shaft 15 is inserted to be rotatable. A flat base plate part 18*b* is provided on one side of the second rotor plate 18 with respect to the axial bore 15. Similarly, the tip of the base plate part 18 is provided with a second locking part 18*c* to which a later-described torsion coil spring 19 is floatingly locked.

Further, an elongated arm part 18*d* is formed in a direction orthogonal to the direction in which the base plate part 18*b* extends with respect to the axial bore 18*a*. This arm part 18*d* is engaged with a tip of the bimetal piece 13 that is provided at the other end of the rocking member 11 and is bent substantially in a "J" shape. As the rocking member 11 rotates, the second rotor plate 18 engaged with the bimetal piece 13 rotates.

The first and second rotor plates 17 and 18 are received in the receiving part 1*a* such that the base part 15*a* of the rotating shaft 15 is inserted through the axial bore 17*a* and 18*a* thereof to be rotatable. Further, the torsion coil spring 19 is floatingly locked to the first and second locking parts 17*c* and 18*c*, which are respectively provided at the tips of the base plate parts 17*b* and 18*b*. Both ends of the torsion coil spring 19 respectively have resilient arm parts made of a metallic wire rod having springiness.

A cover 20 is formed of a metallic material. The cover 20 is provided with a flat upper plate part 20*a*, and a pair of mounting plate parts 20*c* that extend downward from opposite side of the upper plate part 20*a* and that have mounting pieces 20*b*. Further, the upper plate part 20*a* is provided with an insertion hole 20*d* through which the actuating shaft 16 is inserted. When the cover 20 is mounted on the opening part of the case 1, the mounting pieces 20*b* are engaged with the mounting grooves 1*b* of the case 1, so that they are prevented from falling out of the mounting grooves.

Next, the operation of the switch device constructed as above will be described with reference to FIGS. 3 to 9.

First, in an initial state shown in FIG. 3, the rotating shaft 15 does not rotate, and the respective contact plates 2, 3 and 4 of the first and second switch units do not operate, and are maintained in a turned-off state while being spaced from each other.

Next, as shown in FIG. 4, when the actuating shaft 16 is rotated by the operation of rotating an actuating knob (not shown), the rotating shaft 15 also rotates in operative association with the rotational operation. At this time, the driving plate part 12 of the rocking member 11 that is engaged with the convex part of provided in the cam part 15*b* of the rotating shaft 15, moves to the concave part of the cam surface 15*d*, and rotates in the counterclockwise direction about the supporting terminal 10 as a fulcrum. Thereby, the bimetal piece 13 provided at the other end of the rocking member 11 also rotates in the counterclockwise. Then, the elongated arm part 18*d* of the second rotor plate 18 engaged with the substantially J-shaped tip of the bimetal plate 13 is rotated in the counterclockwise direction with the rotation of the bimetal piece 13, similar to the above.

At this time, one resilient arm part of the torsion coil spring 19 that is floatingly locked to the second locking part 18*c* provided at the tip of the second rotor plate 18 on one side thereof with respect to the axial bore 18*a*, also is compressed while it floats in the second locking part 18*c*. When the torsion coil spring 19 goes beyond a reverse point (a dead point) of the tension thereof, i.e., a point that intersects a position where the other resilient arm part is locked to the first locking part 17*c* of the first rotor plate 17, the torsion coil spring 19 is reversed, whereby the first rotor plate 17 rotates in the clockwise direction about the rotating shaft 15 as its axis.

Then, when the first rotor plate 17 rotates in operative association with the rotation of the second rotor plate 18, the tip of the contact driving part 17*d* of the first rotor plate 17 presses the contact plate 2 that constitutes the first switch unit, and is brought in contact with the contact plate 3 provided to face the contact plate 2 against the spring pressure of the contact plate 2. Thereby, the first switch unit is turned on.

At this time, since the contact plates 2 and 3 are formed of a thin metallic plate have flexibility and have their own springiness, the contact plates 2 and 3 are flexed at the time of switching of contacts. Thus, an impact can be softened to reduce noises at the time of the switching.

Further, as the rotating shaft 15 rotates, a cam part (not shown) also presses the contact plate 4 that constitutes the second switch unit. As a result, the contact plate 4 and the terminal plates 7 and 8 are brought in contact with each other. Thereby, the second switch part is turned on simultaneously with the turn on of the first switch unit.

The rotational operation of the rotating shaft 15 allows the first and second switch units to be electrically conducted and thus a circuit of an electronic apparatus to be turned on. In other words, as can be understood from the above construction, the construction of the circuit of the switch device according to the present invention has a double-line construction that is completely electrically interrupted from the load to the electronic apparatus.

In this way, the torsion coil spring 19 is loosely engaged with the first and second locking parts 17*c* and 18*c* of the first and second rotor plates 17 and 18, and when the first rotor plate 17 rotates, the torsion coil spring 19 floats in the first and second locking parts 17*c* and 18*c* so that the torsion coil spring 19 performs the reverse operation. Therefore, when the torsion coil spring 19 goes beyond the reverse point (dead point) of the tension thereof, the torsion coil spring 19 runs by itself in the first and second locking parts 17*c* and 18*c*, whereby the torsion coil spring 19 operates in a reverse direction. As a result, the reverse operation can be surely performed, and the switching of contacts can be instantaneously performed.

Moreover, it goes without saying that the reverse operation by the torsion coil spring 19 as described above can be performed, even if the engagement of the torsion coil spring 19 with the first and second locking parts 17*c* and 18*c* is performed without a sufficient space to run by itself only in a clearance in design.

In the turned-on state of the switch device, i.e., in the state in FIG. 4, the switch device becomes a state in which current is applied to the heater 14 via the contact plates 2 and 3 and the contact plate 4, and the heater 14 is heated during the turned-on state of the first and second switch units.

In this state, when the heater 14 reaches a predetermined temperature, as shown in FIG. 5, the bimetal piece 13 integrally attached to the heater 14 is displaced to the right in the drawing, i.e., in the clockwise direction by heat, whereby the arm part 18*d* of the second rotor plate 18, which is engaged with the tip of the bimetal piece 13, is rotated in the clockwise direction.

FIGS. 6 to 9 show the state of the bimetal piece 13 displaced by heat. FIGS. 6 and 7 show a state immediately before the bimetal piece 13 is displaced to rotate the second rotor plate 18 in the clockwise direction and the torsion coil spring 19 reaches the reverse point (dead point). Further, FIGS. 8 and 9 show a state immediately after the bimetal piece 13 is displaced to rotate the second rotor plate 18 in the clockwise direction and the torsion coil spring 19 is reversed.

From this state, the torsion coil spring 19 is reversed, and the first rotor plate 17 rotates in the counterclockwise direction about the rotating shaft 15 as its axis.

Then, when the first rotor plate 17 rotates in operative association with the rotation of the second rotor plate 18, the tip of the contact driving part 17*d* of the first rotor plate 17 releases the pressing of the contact plate 2 that constitutes the first switch unit, and the spring pressure of the contact plate 2 causes the contact plate 2 to be spaced from the contact plate 3. As a result, the first switch unit is turned off (FIG. 5).

Moreover, in this state, the electrical conductive state of the contact plate 4 and the terminal plates 7 and 8 are maintained, and the second switch part is turned on.

From this state, when the temperature of the heater 14 drops and the bimetal piece 13 returns to the initial state, as shown in FIG. 4, the second rotor plate 18 is rotated with the rotation of the metal piece 13 in the counterclockwise direction, and the first rotor plate 17 rotates in the clockwise direction in operative association with the second rotor plate 18 by the reverse operation of the torsion coil spring 19. Thereby, the tip of the contact driving part 17*d* of the first contact plate 17 presses the contact plate 2 and again comes into contact with the contact plate 3 arranged to face the contact plate 2. As a result, the first switch unit is turned on.

In this way, the switch device having the above construction is most suitable for controlling the output of an external electronic apparatus, for example, a heater such as an electric oven.

According to the construction of the switch device of the present invention as described above, when the actuating shaft 16 is actuated, the bimetal piece 13 causes the first rotor plate 17 to rotate through the second rotor plate 18 with the rotation of the rotating shaft 15, to turn on the pair of contact plates 2 and 3. When the heater 14 is heated to a predetermined temperature, the bimetal piece 13 is displaced to cause the first rotor plate 17 to rotate through the second rotor plate 18 to turn off the pair of turned-on contact plates 2 and 3. When the first rotor plate 17 and the second rotor plate 18 are operatively coupled with each other and with the torsion coil spring 19 for reversing the first rotor plate 17 is rotated, the reversing force of the torsion coil spring 19 causes the contact driving part 17*d* instantaneously to be engaged with or disengaged from the contact plates. Thus, at the time of switching of contacts, the reversing force of the torsion coil spring 19 instantaneously rotates the first rotor plate 17 that drives the contact plate 2. Therefore, generation of arcs can be suppressed, and at the time of reversing of the torsion coil spring, a high contact pressure can always be applied to contacts. As a result, the bouncing of the contacts can be reduced, and the wear of the contacts can be suppressed, so that it is possible to provide a switch device with excellent load life characteristics.

[Advantages]

As described above, a switch device of the present invention comprises: a case having a receiving part, at least a pair of contact plates arranged in the receiving part, a first rotor plate rotatably arranged and having a contact driving part for pressing at least one of the contact plates, a second rotor plate operatively coupled with the first rotor plate, a rotating shaft that journals the first and second rotor plates, a bimetal piece engaged with the second rotor plate for rotating the second rotor plate with the rotation of the rotating shaft, a heater for heating the bimetal piece, and an actuating shaft for rotating the rotating shaft. When the actuating shaft is actuated, the bimetal piece causes the first rotor plate to rotate through the second rotor plate with the rotation of the rotating shaft, to turn on the pair of contact plates. When the heater is heated to a predetermined temperature, the bimetal piece is displaced to cause the first rotor plate to rotate through the second rotor plate to turn off the pair of turned-on contact plates. When the first rotor plate and the second rotor plate are operatively coupled with each other with a torsion coil spring for reversing and the first rotor plate is rotated, a reversing force from the torsion coil spring causes the contact driving part to engage with or disengage from the contact plates. Thus, at the time of switching of contacts, the reversing force of the torsional coil spring instantaneously rotate the first rotor plate that drives the contact plates. Therefore, generation of arcs can be suppressed, and at the time of reversing of the torsion coil spring, a high contact pressure can always be applied to contacts. As a result, the bouncing of the contacts can be reduced, and the wear of the contacts can be suppressed, so that it is possible to provide a switch device with excellent load life characteristics.

Further, the first rotor plate is formed with a first locking part, the second rotor plate is provided with a second locking part, the torsion coil spring is loosely engaged with the first and second locking parts, and when the first rotor plate rotates, the torsion coil spring floats in the first and second locking parts so that the torsion coil spring performs reverse operation. Thus when the torsion coil spring go beyond the reverse point (dead point) of the tension of the torsion coil spring, the torsion coil spring runs by itself in the first and second locking parts, whereby the direction in which the torsion coil spring acts becomes reverse. As a result, the reverse operation can be surely performed and the switching of the contacts can be instantaneously performed.

Further, as a third aspect of the invention, the distance from a rotational fulcrum of the rotating shaft to the locking part between the first rotor plate and the torsional coil spring is longer than the distance from the rotational fulcrum to the contact driving part. As a result, using such a principle, the contact pressure applied to contacts can be set to be larger than the spring pressure applied by the torsion coil spring.

Further, as a fourth aspect of the invention, the pair of contact plates are formed of a springy material having flexibility. As a result, an impact can be softened to reduce noises at the time of switching.

Further, as a fifth aspect of the invention, a plurality of the contact plates are arranged in the receiving part of the case, the contact plates are connected to a plurality of external terminals that lead out of the case, and the external terminals are arranged in a row at the bottom of the case. As a result, at the time of wiring of harnesses, etc., the occurrence of erroneous wiring is prevented, and the workability is improved. A connector, etc., can be connected to the switch device, and the assembling property to a product can be improved.

What is claimed is:

1. A switch device comprising:

a case having a receiving part, at least a pair of contact plates arranged in the receiving part, a first rotor plate rotatably arranged and having a contact driving part for pressing at least one of the contact plates, a second rotor plate operatively coupled with the first rotor plate, a rotating shaft that journals the first and second rotor plates, a bimetal piece engaged with the second rotor plate for rotating the second rotor plate with the rotation of the rotating shaft, a heater for heating the bimetal piece, and an actuating shaft for rotating the rotating shaft, wherein, when the actuating shaft is actuated, the bimetal piece causes the first rotor plate to rotate through the second rotor plate with the rotation of the rotating shaft, to turn on the pair of contact plates, wherein, when the heater is heated to a predetermined temperature, the bimetal piece is displaced to cause the first rotor plate to rotate through the second rotor plate to turn off the pair of turned-on contact plates, and wherein, the first rotor plate and the second rotor plate are operatively coupled with each other with a torsion coil spring and when the first rotor plate is rotated, a reversing force from the torsion coil spring causes the contact driving part to engage with or disengage from the contact plates.

2. The switch device according to claim 1, wherein the first rotor plate is formed with a first locking part, the second rotor plate is provided with a second locking part, the torsion coil spring is loosely engaged with the first and second locking parts, and when the first rotor plate rotates, the torsion coil spring floats in the first and second locking parts so that the torsion coil spring performs reverse operation.

3. The switch device according to claim 2, wherein the distance from a rotational fulcrum of the rotating shaft to the locking part between the first rotor plate and the torsional coil spring is longer than the distance from the rotational fulcrum to the contact driving part.

4. The switch device according to claim 1, wherein the pair of contact plates are formed of a springy material having flexibility.

5. The switch device according to claim 1, wherein a plurality of the contact plates are arranged in the receiving part of the case, the contact plates are connected to a plurality of external terminals that lead out of the case, and the external terminals are arranged in a row at the bottom of the case.

* * * * *